United States Patent [19]

Reynoso

[11] 4,335,854

[45] Jun. 22, 1982

[54] ADJUSTABLE SPA JET WATER AERATOR

[76] Inventor: Arturo S. Reynoso, 27933 Oakmoor, Canyon Country, Calif. 91351

[21] Appl. No.: 157,007

[22] Filed: Jun. 6, 1980

[51] Int. Cl.[3] ..... A61H 33/02; B05B 7/00; B05B 15/08

[52] U.S. Cl. ..... 239/428.5; 4/542; 239/587

[58] Field of Search ..... 4/492, 540–542; 261/DIG. 22; 128/66; 239/428.5, 587

[56] References Cited

U.S. PATENT DOCUMENTS

| | | | |
|---|---|---|---|
| 2,799,866 | 7/1957 | Jawett | 4/542 |
| 3,297,025 | 1/1967 | Jacuzzi | 128/66 |
| 4,264,039 | 4/1981 | Moreland | 4/542 X |

*Primary Examiner*—Andres Kashnikow
*Attorney, Agent, or Firm*—John J. Posta, Jr.

[57] ABSTRACT

An adjustable spa jet water aerator is provided which is very compact, simple, inexpensive, and durable and which provides for easy separate adjustment of water and air flow therethrough. The aerator is directly securable within a spa wall. It comprises a housing defining water and air conduits disposed in side-by-side relation with a cylindrical passageway therebetween and extending perpendicular to the conduits. The passageway extends to the exterior of the housing at the front end thereof. The conduits have openings communicating with the base of the passageway through alignable openings in a pair of sleeves concentrically disposed for rotation in the passageway. Manual rotation of the sleeves individually controls the flow of water and air from the conduits. The inner sleeve defines an aerating chamber in the passageway. An eyeball type nozzle is disposed in the exit end of the aerating chamber and can include a rotatable restrictor ring for adjusting the flow of aerated water from the spa jet aerator.

13 Claims, 3 Drawing Figures

ADJUSTABLE SPA JET WATER AERATOR

BACKGROUND OF THE INVENTION

1. Field of the Invention

The present invention generally relates to aerators and more particularly to spa jet water aerators of an improved adjustable type.

2. Prior Art

Many of the usual types of water aerators for spas are relatively large, bulky, heavy and expensive. In many cases where new spas are being constructed and/or where existing spas are being refitted, space limitations prevent the use of the larger bulkier aerators.

Moreover, cash can be a factor, especially where a large number of aerators are needed. There is also a problem of adjusting the flow of water and air to provide the desired aeration. Many conventional aerators are difficult to properly adjust after they are installed in spa walls. Yet conditions may dictate more adjustments to achieve maximum desired results.

Accordingly, it would be highly desirable to be able to provide an inexpensive, durable, effective spa jet aerator which could be easily and quickly adjusted from time to time. It would also be highly desirable if the aerator could be made very compact so as to easily fit into new spa walls during construction and also pre-existing older spa walls as needed.

SUMMARY OF THE INVENTION

The improved spa jet aerator of the present invention satisfies all the foregoing needs. It is substantially as set forth in the Abstract above.

Thus, it comprises a very compact lightweight housing which can be made of a one piece molded plastic construction. The housing defines a pair of spaced water and air conduits, each containing an opening. The conduits are connected to water and air inlet lines.

A central cylindrical passageway is disposed in the housing between the two conduits and extends perpendicular thereto and forward thereof to terminate at the front exterior of the housing.

A pair of concentric cylindrical sleeves are threadably disposed in the housing. Each sleeve has an aperture adjacent its rear end which is alignable with one of the openings in the conduits so as to control the flow of water and air therefrom into the aerating chamber defined by the innermost sleeve.

An eyeball type nozzle may be disposed in the exit end of the aerating chamber to control the direction of exit of aerated water. Moreover, the front ends of the sleeves have finger grips to facilitate manual rotation of the sleeves for the desired water and air control.

The housing is equipped with one or more clamps to grip and hold the housing in an opening in a spa wall. The housing, sleeves, and nozzle can be made of plastic, if desired, to decrease cost, size and weight. The aerator is very efficient and inexpensive and can be fitted into small spaces. Further features are set forth in the following detailed description and accompanying drawings.

DRAWINGS

DETAILED DESCRIPTION

Figure 1:
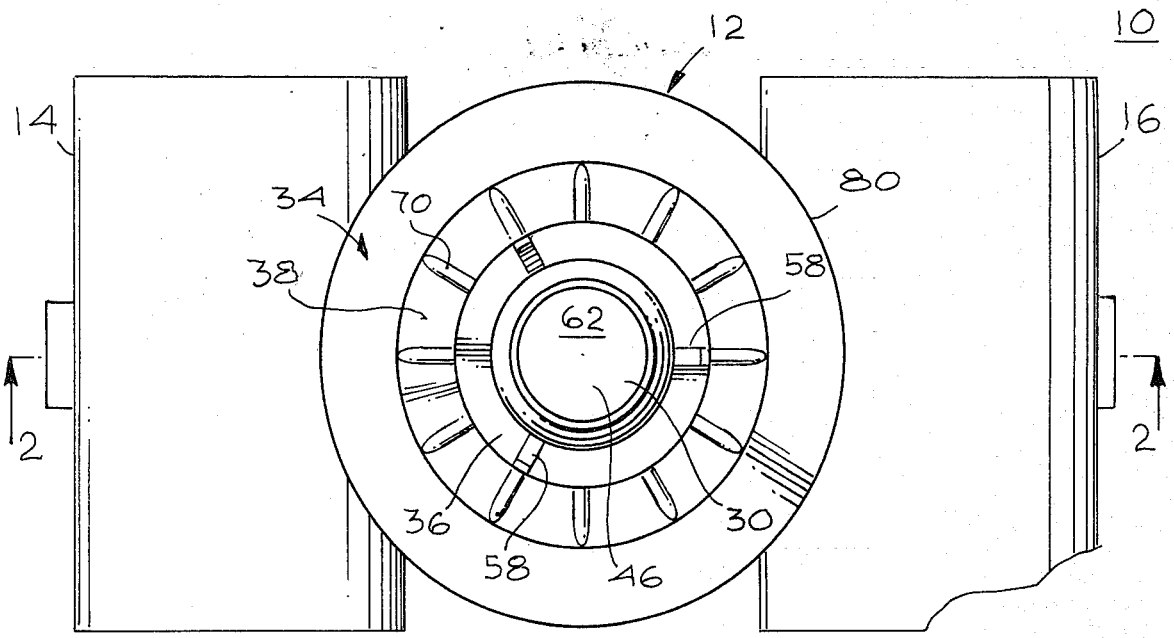
FIG. 1 is a schematic front elevation of a preferred embodiment of the improved adjustable spa jet aerator of the present invention.
Figure 2:
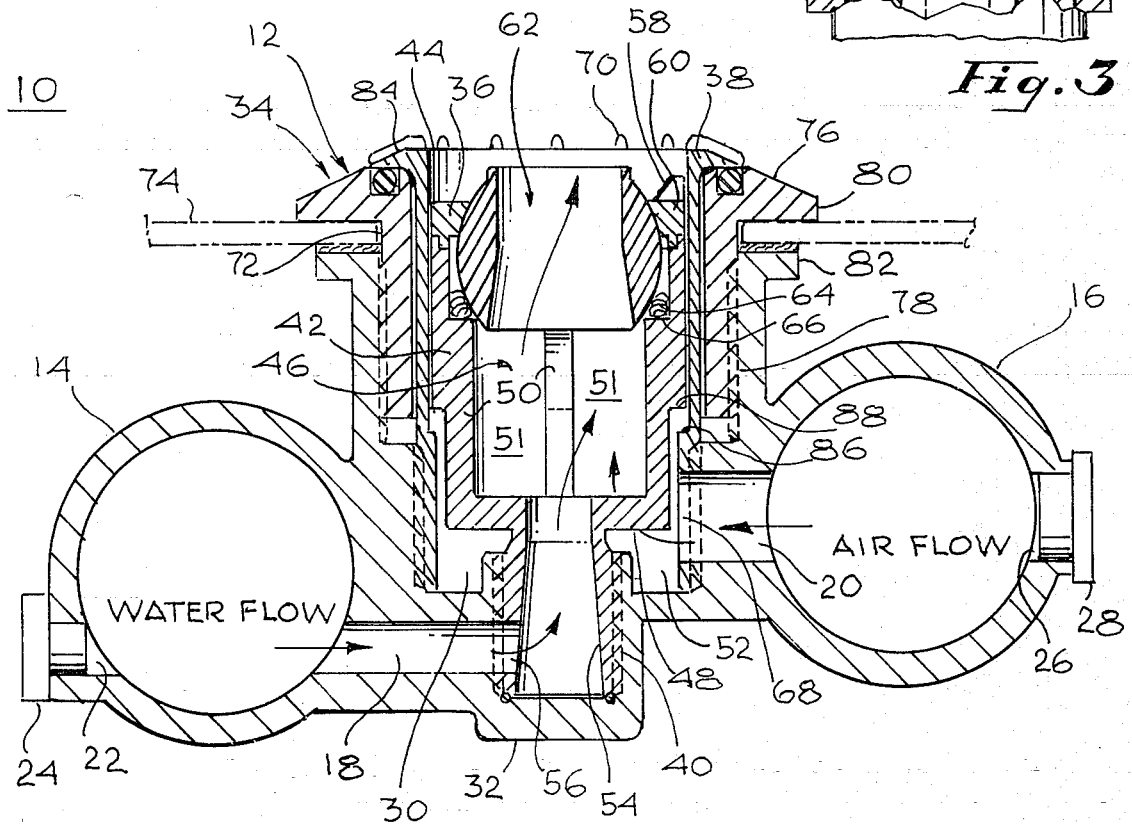
FIG. 2 is a schematic cross section of the improved adjustable spa jet aerator of the present invention, taken along the section line 2—2 of FIG. 1.

FIGS. 1 and 2

Now referring more particularly to FIGS. 1 and 2 of the accompanying drawings, a preferred embodiment of the improved adjustable spa jet aerator of the present invention is schematically depicted therein.

Thus, aerator 10 is shown which comprises a hollow housing 12 of metal, ceramic, plastic or the like, preferably plastic. Housing 12 defines a water conduit 14 and an air conduit 16 spaced laterally therefrom. Conduit 14 has an opening 18 in the form of a passageway on its medial side and conduit 16 has an opening 20 in the form of a passageway on its medial side.

Conduit 14 may also have an access opening 22 fitted with plug 24 on its distal side and conduit 16 may have an access opening 26 fitted with a plug 28 on its distal side. This is particularly the case when housing 12 is of unitary one-piece molded plastic; openings 22 and 26 being needed in the forming operation.

Housing 12 also defines a central cylindrical passageway 30 extending from adjacent the rear end 32 of housing to the exterior at the front end 34 of housing 12. Passageway 30 is shown in FIG. 2 as perpendicular to conduits 14 and 16, although this need not be the case; but in any event passageway 30 extends forward of conduits 14 and 16.

Passageway 30 receives a pair of concentric sleeves 36 and 38 threaded to housing 12. Inner sleeve 36 is shown in FIG. 2 as threaded to the inner surface of the rear necked down portion 40 of housing 12 and comprises a cup 42 having an open front end 44. Cup 42 defines a central aeration chamber 46.

The base or rear end 48 of cup 42 is in the form of a depending cage-like section having a plurality of depending legs 50 defining apertures 51 thereby allowing communication between chamber 46, space 52 and opening 20.

The hollow stem portion 54 of sleeve 36, that is, the portion connected to and rearward of cup 42 is received within portion 40, and has an aperture 56 therein which is alignable with the medial end of opening 18. Thus, rotation of sleeve 36 brings aperture 56 into and out of alignment with opening 18 for full control of water flow from conduit 14 into aeration chamber 46. Such rotation is effected by manually gripping an extension 58 on a retainer plug 60 secured to the front edge of sleeve 36.

Plug 60 is suitably shaped to retain an eyeball type nozzle 62 in place for rotation without forward dislodgment, while one or more springs 64 disposed in an annular recess 66 in the front end of sleeve 56 urge nozzle 62 forward against plug 60.

Thus, nozzle 62 seals aeration chamber 46 to prevent water from exiting housing 12, except through nozzle 62, and in a desired direction, as determined by manual rotation of nozzle 62.

Sleeve 38 has an aperture 68 alignable in space 52 with the medial end of opening 20. The front end of sleeve 38 is provided with a plurality of spaced gripping ribs 70 adapted to facilitate manual rotation of sleeve to move aperature 68 into and out of alignment with opening 20 and thus control the flow of air from conduit 16, through opening 20, space 52, aperture 68 and aperture 50 into aeration chamber 46.

It will be understood that ribs 70 and extension 58, as well as nozzle 62, are readily manually accessible at the front end 34 of housing 12, even when housing 12 is installed in an opening 72 in a spa wall 74. This is because of the forward projection of nozzle 62 and sleeves 36 and 38.

In order to adjustably secure housing 12 in the desired location, housing 12 can be provided with a center cylindrical sleeve clamp 76 threadably secured to the inner surface of the front portion 78 of housing 12. Clamp 76 has a peripheral extension adapted to abut the inner face of spa wall 74 while portion 78 of housing 12 has a similar peripheral extension 82 adapted to abut the outer surface of spa wall 74. Clamp 76 can be rotated until spa wall 74 is tightly gripped between extensions 80 and 82.

In installing aerator 10, sleeve 36 is first removed from housing 12, then sleeve 38 and finally clamp 76. Housing 12 is then placed in opening 72, whereupon clamp 76 is installed then sleeve 38, and finally sleeve 36. This sequence is necessary because of the fact that the front end 84 of sleeve 38 may overlap clamp 76 and because the mid portion of sleeve 38 includes an inwardly directed limit shoulder or rim 86 upon which a portion 88 of cup 42 can be seated (FIG. 2). Thereafter, upon connection of conduits 14 and 16 with separate water and air supply lines (not shown) and suitable adjustment of sleeves 36 and 38, aerator 10 is ready for use.

During use of aerator 10, a controlled flow of air through conduit 16, opening 20, aperture 68, space 52 and aperture 51 into chamber 46 occurs, while simultaneously a controlled flow of water from conduit 14 through opening 18 and aperture 56 into chamber 46 also occurs.

The water and air continuously mix in chamber 46 so that the water is thoroughly and controlledly aerated and then exits housing 12 in a controlled direction through nozzle 62 and into a spa, usually below the water level. A plurality of aerators 10 can be spaced around the spa at one or more levels and are easily reached for water and air adjustment from within the spa.

It will be understood that, if desired, conduit 14 could be an air conduit, in which case conduit 16 would be a water conduit. It will also be understood that the cup and stem configuration of sleeve 36 need not be followed. Another suitable configuration could be used. Moreover, the location, size and shape of apertures 56 and 68 can be varied, as desired. In any event, aerator 10 is simple, inexpensive, durable, compact, light weight and effective.

FIG. 3

Figure 3:
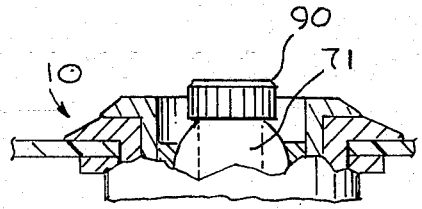
FIG. 3 is a schematic top plan view partly broken away, of the adjustable spa jet aerator of FIG. 1, employing a modified adjustable eyeball nozzle.

A modification of the nozzle 70 is shown in FIG. 3. Thus, as indicated in FIG. 3 (a top plan view of aerator 10, partly broken away) nozzle 70 can be outfitted with a manual adjustable ring assembly 90 constrictor of conventional configuration and construction to control the flow rate of aerated water from nozzle 70. Such assembly 90 may include a variable aperture iris diaphragm (not shown) or the like to vary the diameter of the exit end of the flow passage in nozzle 70.

Various other modifications, changes, alterations or additions can be made in the improved adjustable spa jet water aerator of the present invention, its components and their parameters. All such changes, modifications, alterations, and additions as are within the scope of the appended claims form part of the present invention.

What is claimed is:

1. An adjustable spa jet aerator, comprising a housing having a passageway therein, said housing having a first inlet opening adapted to communicate with a source of pressurized water, said housing having a second inlet opening adapted to communicate with a source of pressurized air, effluent control means for varying the ratio of air to water mixture emitted from said aerator, said effluent control means including air flow adjusting means secured in said passageway, and water flow adjusting means secured in said passageway, said effluent control means enabling independent control of air flow and/or water flow from said aerator, wherein said air flow adjustable means and water flow adjustable means are concentrically disposed in said passageway.

2. The improved spa jet aerator of claim 1 wherein portions of each of said air flow adjustable means and water flow adjustable means extend outside said housing to facilitate water and air flow adjustment.

3. The improved spa jet aerator of claim 1 wherein siad water flow adjustable means and air flow adjustable means are rotatably secured within said housing and are adjusted by the rotation thereof.

4. The improved spa jet aerator of claim 3 and further including nozzle means pivotably secured in said passageway.

5. An improved adjustable spa jet aerator, said aerator comprising in combination:

a. a hollow housing defining therein an air conduit and a water conduit spaced therefrom, a passageway disposed therebetween, and openings in said conduits communicating with the front exterior of said housing;

b. air adjusting means and water adjusting means rotatably secured in said passageway in concentric array and rotatably adjustable, one of said water and air adjusting means defining an aerating chamber in communication with said conduits;

c. nozzle means pivotably secured in said aerating chamber;

d. means for retaining said aerator in a spa wall, and e. wherein said air adjusting means and said water adjusting means comprise concentric sleeves rotatably received in the exit end of said passageway and wherein said sleeves contain openings rotatable into and out of alignment with said conduit openings to control the flow of water and air from said conduits to said passageway.

6. The improved spa jet aerator of claim 5 wherein said retaining means comprises clamp means positioned to releasably secure said housing in a spa wall so that the exit end of said passageway with said nozzle and sleeves can project into a spa for ready access.

7. The improved spa jet aerator of claim 6 wherein the exit ends of said sleeves bear finger grips to facilitate rotation of said sleeves for said water and air adjustment, wherein said water adjusting sleeve defines said aerating chamber and includes a rear base bearing said water adjustment opening and wherein said nozzle is of the eyeball type.

8. The improved spa jet aerator of claim 7 wherein said conduits are disposed in side by side relation adjacent the rear end of said housing and wherein said passageway projects forward of said conduits; generally perpendicular to said conduits.

9. The improved spa jet aerator of claim 8 wherein said housing is of one piece molded plastic construction and wherein said sleeves and nozzle are also of plastic.

10. The improved spa jet aerator of claim 7 wherein said base comprises a hollow stem and wherein the front portion of said water adjusting sleeve is cup-shaped.

11. The improved spa jet aerator of claim 5 wherein the exit ends of said sleeves bear gripping means to facilitate rotation of said sleeves for said water and air adjustment.

12. The improved spa jet aerator of claim 5 wherein said water adjusting sleeve defines said aerating chamber and includes a base threadably received in said housing and defining said water adjustment opening.

13. The improved spa jet aerator of claim 5 wherein said housing is of unitary molded plastic construction.

* * * * *